United States Patent [19]

Jackson

[11] Patent Number: 5,058,886

[45] Date of Patent: Oct. 22, 1991

[54] ACCESSORY FOR POSITIONING THE BAR OF A FREE WEIGHT ONTO THE LEGS OF A USER

[76] Inventor: Richard Jackson, 126 Wilcox, #302, Rochester, Mich. 48063

[21] Appl. No.: 484,699

[22] Filed: Feb. 22, 1990

[51] Int. Cl.[5] ..... A63B 21/072

[52] U.S. Cl. ..... 272/123; 224/222

[58] Field of Search ..... 272/93, 119, 117, 122, 272/123, 143; 224/222, 265, 266, 267, 270; 128/78, 87 B

[56] References Cited

U.S. PATENT DOCUMENTS

| | | | |
|---|---|---|---|
| 2,701,173 | 2/1955 | Senior et al. | 224/267 X |
| 4,103,809 | 8/1978 | Frost et al. | 224/222 |
| 4,199,140 | 4/1980 | Ferretti | 272/123 |
| 4,213,605 | 7/1980 | McPeak | 272/119 |
| 4,391,397 | 7/1983 | Taylor, Jr. | 272/119 X |
| 4,572,305 | 2/1986 | Swietlik . | |
| 4,572,505 | 2/1986 | Kornhaus . | |
| 4,623,143 | 11/1986 | Wuellenweber . | |
| 4,629,183 | 12/1986 | Perrine | 272/119 X |
| 4,648,603 | 3/1987 | Hayford, Jr. | 224/222 X |
| 4,665,388 | 5/1987 | Ivie et al. | 272/123 X |
| 4,676,502 | 6/1987 | Mahr | 272/119 |
| 4,696,469 | 9/1987 | Elder . | |
| 4,722,524 | 2/1988 | Waszkelewicz | 272/123 |

*Primary Examiner*—Robert Bahr

*Attorney, Agent, or Firm*—Gifford, Groh, Sprinkle, Patmore & Anderson

[57] ABSTRACT

A free weight accessory for positioning the bar of a bar bell and the like on the ventral side of the upper leg regions of the user. The accessory includes a body portion preferably made of aluminum, plastic or fiberglass having a pair of side-by-side, spaced apart parallel channels defined on the underside thereof for removably accomodating the legs of a user while the user is in a seated position. The top side of the accessory includes dimpled projections for positioning the bar of the bar bell. The underside of the dimpled projections are concave thereby permitting stacking of the accessories one atop the other for storage and shipping. An elastic belt is optionally provided for removable attachment of the accessory to the user's leg.

17 Claims, 1 Drawing Sheet

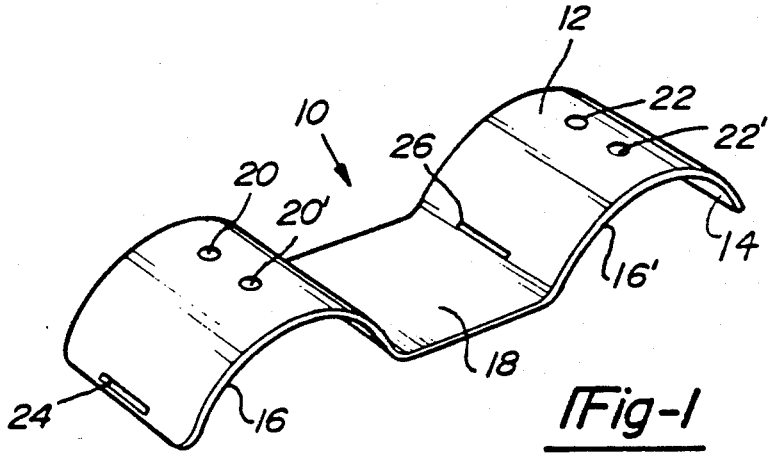
Fig-1
Fig-2
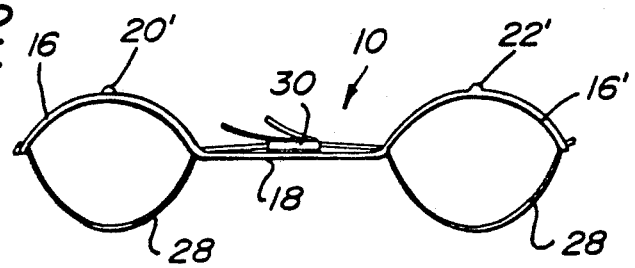
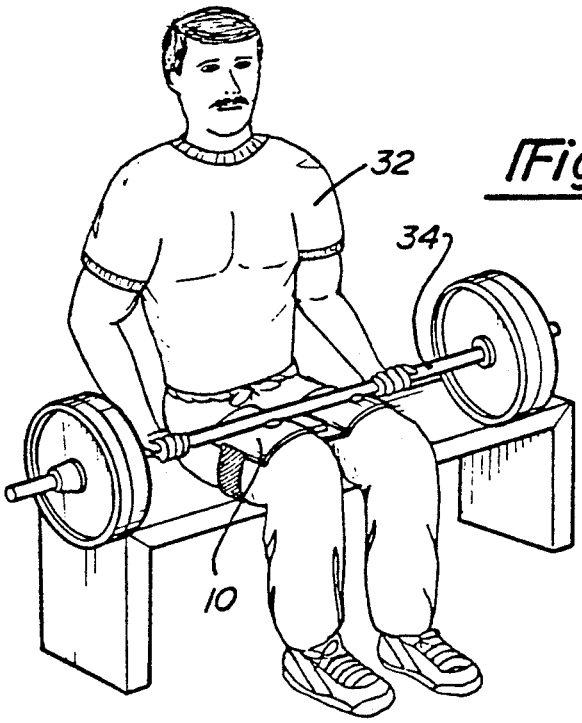
Fig-3

ACCESSORY FOR POSITIONING THE BAR OF A FREE WEIGHT ONTO THE LEGS OF A USER

BACKGROUND OF THE INVENTION

I. Field of the Invention

The present invention relates generally to accessories for use with free weights. More particularly, the present invention relates to a free weight accessory for positioning the bar of a bar bell and the like onto the ventral side of the upper leg regions of a user.

II. Description of the Relevant Art

Optimum physical fitness demands both aerobic and anaerobic conditioning. Aerobic conditioning, or oxygen-using activity, is well known and includes such activities as bicycling and running. Anaerobic activity includes activities such as weight lifting. As overall physical well-being is now being stressed for persons of all ages, this latter type of activity, weight lifting, is becoming increasingly popular.

Of known methods of weight lifting, two general divisions may be identified. First is the type of weight lifting requiring use of a weight machine where no loose parts, such as weights, are available. All of the differing increments of usable weights are slidably fitted onto one or more racks or shafts. Adjustment from one amount of weight to another is accomplished by locating and relocating pins slidingly engagable with slots in the respective weights.

The greatest advantage of this type of system over free weights is that the weight machine minimizes the risk of dropping weights in that the weights are constrained to move only on the racks or shafts. Adjustment is also accomplished easily. However, the weight machine suffers from a great disadvantage in that it is very costly and usually requires a considerable amount of room for set-up and use.

The other division of weight utilization is the use of free weights and bar bell bars. The free weights typically include a number of differently-weighted, disk-shaped elements that are slidably attachable to a bar bell bar. By turning down a fastener, the weight may be attached to the bar.

The use of free weights offers a number of advantages over use of a weight machine. Among those advantages is the relatively low expense associated with such equipment and its ready availability. Free weights also offer the user freedom of use, as the weights may be worked in many places.

However, free weights suffer from a number of disadvantages, the greatest of which, as noted above, relates to safety and the possibility of dropping weights. Relatedly, weights tend to be somewhat unwieldy and have a tendency to shift or roll from one position to another, often beyond the control of the user. This situation is exacerbated because of the stressed condition of the user during workout periods.

Accordingly, little has been done to make the free weight safer or more convenient to use and, as a result, the use of the free weight system has progressed little since its early use.

SUMMARY OF THE PRESENT INVENTION

The present invention provides an accessory for placement onto the ventral side of the upper leg portions of the user for fitting thereupon the bar of a free weight bar bell. While using the accessory, the user is in a sitting position with the bar of the bar bell fitted perpendicularly across the legs. This position allows the user to successfully undertake leg lifts whereby the plantar muscles of the foot are stretched with the toes and forward part of the underside of the foot remaining on the ground and the heel portion being lifted. This exercise is valuable in that the gastrocnemius muscles are exercised in conjunction with use of the Achilles' tendon.

The accessory of the present invention is composed of an accessory body having a top side and a bottom side. The body is composed of a light weight rigid material such as aluminum, fiberglass or a plastic.

The body includes a pair of side-by-side, spaced apart channels defined in parallel on the underside thereof. The channels are configured so as to removably receive the upper leg portions of the user. The accessory is placed upon the top or ventral side of the user's legs.

On the upper side of the accessory body are situated a number of bar positioning fittings. These fittings comprise elevated dimples. Two dimples are each fitted over each channel in an axial manner. Each dimple of the pair is positioned in a spaced apart relation with respect to the other. By this construction, the bar of the bar bell may be positioned perpendicularly with respect to the user's legs. This construction also allows for the easy removal of the bar from the legs of the user.

On the underside of the elevated dimples are defined four corresponding concave indentations. These indentations allow for the stacking of the accessories one atop the other for convenient storage or shipping.

As preferred, in an optional embodiment of the accessory, the body may include a number of slots for accomodating an elastic strap. The strap may be placed around the legs of the user to allow for greater security and for improved adhesion of the accessory to the user's legs.

The use of the free weight in conjunction with the accessory of the present invention provides the user with a safe and effective way of using the weights while concurrently acquiring the selected exercise.

The accessory of the present invention offers a great advantage in that it contains no working parts and is, in its simplest embodiment, only composed of one piece.

In operation, the accessory offers another great advantage in that it helps to distribute weight over the top of the legs very efficiently to minimize discomfort and to allow for a heavier and thereby more effective workout.

Other advantages and features of the present invention will become more apparent from the following detailed description when read in conjunction with the accompanying drawing.

BRIEF DESCRIPTION OF THE DRAWING

The present invention will be more fully understood by reference to the following detailed description of the preferred embodiments of the present invention when read in conjunction with the accompanying drawing, in which like reference characters refer to like parts throughout the views, and in which:

FIG. 1 is a perspective view of the weight accessory of the present invention shown without the optional strap:

FIG. 2 is a raised elevational view of the present invention illustrating an alternate embodiment of the present invention with the holding strap in place; and FIG. 3 is a perspective view illustrating the invention of the present invention in place on the legs of a user.

DETAILED DESCRIPTION OF THE PREFERRED EMBODIMENTS OF THE PRESENT INVENTION

The drawing discloses the preferred embodiments of the present invention. While the configurations according to the illustrated embodiments are preferred, it is envisioned that alternate configurations of the present invention may be adopted without deviating from the invention as portrayed. The preferred embodiments are discussed hereafter.

Referring to FIG. 1, a weight accessory according to the present invention is shown and is generally indicated as 10. The accessory 10 includes a top side 12 which may be viewed from this perspective and a complementary bottom side 14. As noted, the accessory 10 is preferably composed of a light weight material such as aluminum, fiberglass, or a plastic. A hard rubber may also be selected.

The accessory 10 includes a pair of spaced apart, side-by-side channelled portions 16, 16' defined substantially in parallel with one another. Interconnecting the channelled portions 16, 16' is an intermediate portion 18. The intermediate portion 18 may be narrower or wider than depicted as may be preferred for the comfort, age and build of the user.

On the top side 12 of the accessory 10 are provided a plurality of elevated dimples 20, 20', 22, 22'. The dimples 20, 20' are provided axially with respect to the axis of the channelled portion 16. The dimples 22, 22' are provided axially with respect to the axis of the channelled portion 16'. In their side-by-side, spaced apart positioning, the dimples 20, 20' hold a bar therebetween as do the dimples 22, 22' as may be understood by reference to FIG. 3.

Each of the dimples 20, 20', 22, 22' has a complementary concave depression defined on the bottom side 14. This construction allows for stacking of two or more of the accessories 10 atop one another for storage, shipment or the like.

Still referring to FIG. 1, the accessory 10 has optionally provided therein a plurality of axially defined slots of which slots 24, 26 may be seen. The function of the slots 24, 26 (and others) is to allow for placement therethrough of an attachment strap as may be seen in FIG. 2.

With reference to FIG. 2, a strap 28 is shown in place upon the accessory 10. The strap 28 includes a buckle assembly 30 provided thereon. Although the accessory 10 may be successfully used without the strap 28 and its associated buckle, these elements provide the accessory with additional stability which may be desired.

With reference to FIG. 3, a user 32 holds a bar bell free weight assembly 34 upon the accessory 10. From this position the user 32 may elevate his heels and, with only a small amount of force through his hands and arms, stabilize the weight assembly 34 upon the accessory 10. Thus exercising may be effectively accomplished with only a minimum of danger or constraint by equipment.

Having described my invention, however, many modifications thereto will become apparent to those skilled in the art to which it pertains without deviation from the spirit of the invention as defined by the scope of the appended claims.

I claim:

1. A free weight accessory for positioning the bar of a bar bell and the like on the ventral side of the upper leg regions of a user, said accessory comprising:

an accessory body;

said body including a pair of spaced apart channelled regions situated substantially in a side-by-side parallel relationship to one another said channel regions having an upper side and a complementary bottom side removably receiving said legs of said user;

said body further including means for positioning said bar thereon provided on said upper side of said channelled region;

said means for positioning being defined by two sets of two dimples, each of said sets of dimples being substantially situated axially with respect to each of said user's legs, and elevated sufficiently above said channelled regions for positioning a bar bell thereon.

2. A free weight accessory for positioning the bar of a bar bell and the like on the leg of the user, said accessory comprising:

an accessory body;

said body including a first channelled region and a second channelled region, said first and second channelled regions being spaced apart and being situated substantially in parallel for removably receiving and balancing a bar bell;

said body having a top side and a bottom side;

said top side forms a channelled region over each of said channelled region;

said top side further including means for positioning said bar of said bar bell thereupon over said top side of said channelled region;

said means for positioning being defined by two sets of two dimples, each of said sets of dimples being substantially situated axially with respect to each of said user's legs, and elevated sufficiently above said channelled regions for positioning a bar bell thereon.

3. The accessory of claim 2 wherein said body has defined on said bottom side indentations beneath each of said dimples whereby a plurality of said accessories may be stacked one atop the other.

4. The accessory of claim 2 wherein said body is composed of aluminum.

5. The accessory of claim 2 wherein said accessory further includes means for removably attaching said body to said legs of said user.

6. The accessory of claim 5 wherein said means for removably attaching comprises a strap.

7. The accessory of claim 6 wherein said body has a plurality of elongated slots defined therein for receiving said strap.

8. The accessory of claim 7 wherein:

said first channelled region includes an exterior end region and an interior end region; and said second channelled region includes an interior end region and an exterior end region.

9. The accessory of claim 8 wherein said slots are defined in said interior end regions and said exterior end regions.

10. The accessory of claim 9 wherein said body further includes a substantially planar intermediate portion interconnecting said first channelled region and said second channelled region.

11. A free weight accessory for use in association with one or more weights, said accessory comprising:

an accessory body;

said body having a top side and a bottom side;

said bottom side having defined therein channels for receiving one or more legs of the user;

said upper side forming two channelled regions;

said channelled regions each having provided thereon means for removably positioning said free weight accessory for use in association with one or more weights;

said means for removably positioning being defined by two sets of two dimples, each of said sets of dimples being substantially situated axially with respect to each of said user's legs; and elevated sufficiently above said channelled regions for positioning a bar bell thereon.

12. The accessory of claim 11 further including means for removably attaching said body to the legs of a user.

13. The accessory of claim 12 wherein said means comprises an elastic strap.

14. The accessory of claim 11 wherein said means for removably positioning comprises a plurality of elevated regions for slottingly receiving said one or more weights therein.

15. The accessory of claim 11 wherein two of said channels are provided, said channels being situated substantially parallel to one another in a side-by-side, spaced apart relationship.

16. The accessory of claim 15 further including an intermediate portion situated between said two channels.

17. The accessory of claim 11 wherein said body is composed of a polymerized material.

* * * * *